US006732395B2

(12) United States Patent
Gringer

(10) Patent No.: US 6,732,395 B2
(45) Date of Patent: May 11, 2004

(54) CONTOUR PULL SCRAPER WITH STOWABLE FILE

(76) Inventor: Donald Gringer, 800 Park Ave., New York, NY (US) 10021

( * ) Notice: Subject to any disclaimer, the term of this patent is extended or adjusted under 35 U.S.C. 154(b) by 244 days.

(21) Appl. No.: 10/022,353

(22) Filed: Dec. 13, 2001

(65) Prior Publication Data

US 2003/0110641 A1 Jun. 19, 2003

(51) Int. Cl.[7] ..... B26B 3/00; B26B 11/00

(52) U.S. Cl. ..... 15/105; 15/143.1; 15/236.01; 30/169

(58) Field of Search ..... 15/236.05, 236.06, 15/236.07, 105, 143.1, 236.01; 30/172, 357, 169

(56) References Cited

U.S. PATENT DOCUMENTS 822,928 A * 6/1906 Delano ..... 15/105
3,363,316 A * 1/1968 Skarsten ..... 30/171
5,309,598 A * 5/1994 Carpenter ..... 15/236.08
D424,767 S * 5/2000 Shea ..... D32/48
D453,251 S * 1/2002 Gringer et al. ..... D32/48
6,629,331 B2 * 10/2003 Panfili et al. ..... 15/236.06

* cited by examiner

*Primary Examiner*—Robert J. Warden, Sr.
*Assistant Examiner*—S Balsis
(74) *Attorney, Agent, or Firm*—Lackenbach Siegel, LLP

(57) ABSTRACT

A contour scraper has an elongated handle having an upper curved convex surface and two arcuate elongated concave lower surfaces and outwardly proximately flared sides to provide a grip construction, and a transversely distally disposed blade receiving surface. A two-edged blade is readily reversibly detachably attached to the handle without the need for removing a locking screw. The handle grip has an over molded soft elastomeric cover. The handle is formed with a distal end slotted recess to slidably receive a file. A rare earth magnet of high magnetic strength magnetically holds and stows the file in the handle. The handle is formed with a through hole to access the magnetically stowed file for removal through the end slot.

22 Claims, 7 Drawing Sheets

FIG.1
PRIOR ART
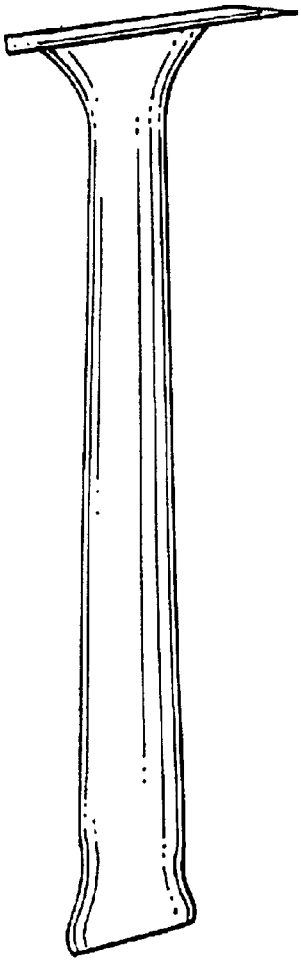
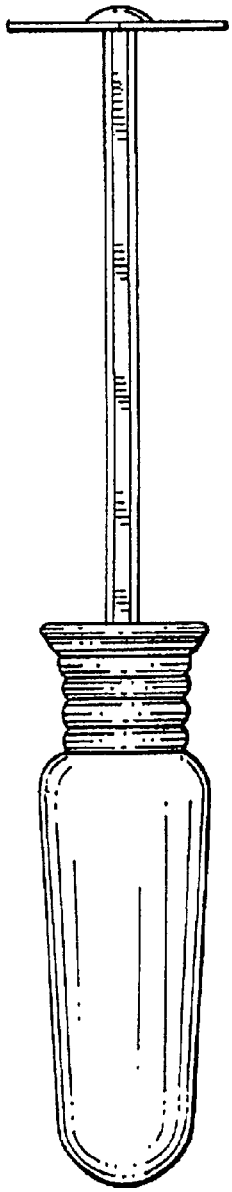
FIG.3
PRIOR ART
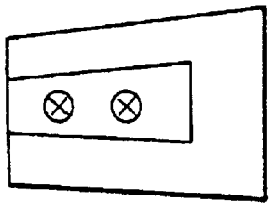
FIG.2
PRIOR ART
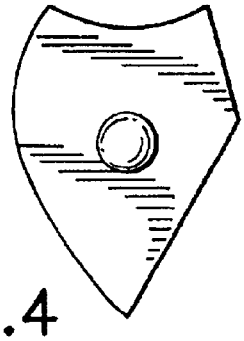
FIG.4
PRIOR ART

CONTOUR PULL SCRAPER WITH STOWABLE FILE

BACKGROUND OF THE INVENTION

1. Field of the Invention

This invention relates to scrapers. Specifically this invention relates to contour scrapers. In another respect this invention relates to contour scrapers as combination tools.

2. Background and Discussion of the Prior Art

Contour scrapers are used to scrape surfaces such as moldings and the like. Prior art contour scrapers had elongated handles and often had an elongated metal shank, which handle and shank were generally coaxially disposed. Such prior art contour scrapers are shown in FIGS. 1–8. These prior art contour scrapers caused fatigue in repetitive use. Further such prior art contour scrapers provided at best limited clearance and often interference with rubbing of the user's knuckles when the blade edge was disposed at an acute angle with respect to the work surface.

The contour scraper art desired a construction which avoided such interference and yet provided fine operational control in the blade angle to work surface, particularly where the blade was disposed at an acute angle with respect to the work surface. The contour scraper art also desired a scraper which reduced fatigue with repetitive use.

The contour scraper blades required constant resharpening or filing of the blade edge. This necessitated access to a file. The user would often have to cease scraping and locate a suitable file for the blade in use.

The early patent U.S. Pat. No. 822,928 granted in 1906 to Delano, disclosed a file which was stored in the scraper handle. The file was only accessible by removal of a plug at the proximate of end of the handle. A compression spring was disposed within the handle so that with removal of the plug the spring would force the file out the proximate end. If the plug was lost or misplaced, the stowable file feature was rendered inoperable as the file would be forced out of the handle and fall out of the handle in use particularly in the upward vertical disposition.

The contour scraper art desired a scraper which eliminated the before-described file access impediments.

The prior art scrapers generally required disassembly or screw removal for blade replacement. Such disassembly or screw removal created the opportunity for lost or misplaced parts or elements rendering the scraper inoperable. The contour scraper art desired improved blade removal and replacement.

The present invention provides solutions to the prior art interference, blade removal and file access impediments.

SUMMARY OF THE INVENTION

The contour scraper of the present invention has a handle with specifically contoured grip surfaces and a distally angularly disposed blade receiving surface. The handle has an elongated arcuate axis, an upper proximately downwardly disposed curved surface, and a lower curved surface formed with two elongated curved finger receiving recesses. The handle has outwardly extending sides which are flared outwardly towards the proximate end. The blade receiving surface is distally angularly disposed, and in substantial part disposed below the upper grip surface. The blade receiving surface is formed with means to detachably operably receive one of a plurality of interchangeable double-edged blades.

The double-edged blade receiving surface is formed with a cylindrical post and a spatially disposed locking screw.

The double-edged blade is formed with a keyhole opening which has opposed part circular edges and a contiguous central part circular enlarged opening. The central opening is larger than the locking screw head. The post engages one opposed part circular edge, and the screw engages the other opposed part circular edge. When the screw is loosened, but not necessarily removed, the blade is reversed or removed and replaced.

The handle is provided with a proximate end slotted recess. A file is slidably received and stowed in the recess. A permanent rare earth metal magnet is fixedly disposed in the handle at the recess end wall. The magnet is a rare earth metal magnet thereby being of sufficient magnetic force to magnetically hold the file in the handle during scraping operations. The handle has an enlarged vertically disposed through hole adjacent its proximate end, whereby the user is able to access the file through the vertically disposed hole to remove the file through the proximate end slot.

The handle has a hard thermoplastic core and an elastomeric molded over soft grip cover for added comfort in repetitive scraping operations.

BRIEF DESCRIPTION OF THE DRAWINGS

FIG. 1 is a side elevational view of one prior art scraper;

FIG. 2 is a distal end view of the scraper of FIG. 1;

FIG. 3 is a side elevational view of a second prior art scraper;

FIG. 4 is a distal end view of the scraper of FIG. 3;

DESCRIPTION OF THE PREFERRED EMBODIMENT

Figure 5:
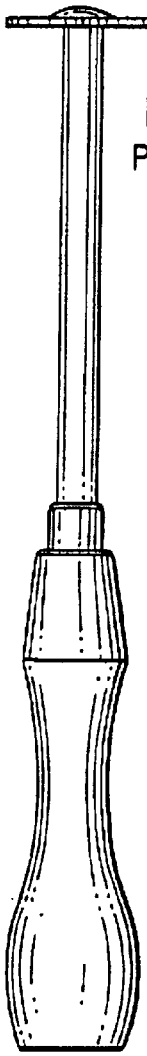
FIG.5 PRIOR ART
FIG. 5 is a side elevational view of a third prior art scraper.
Figure 7:
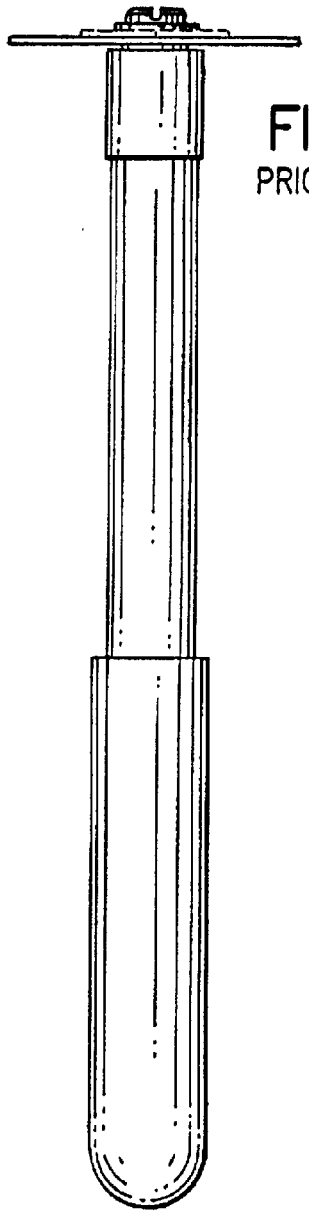
FIG.7 PRIOR ART
FIG. 7 is a side elevational view of a fourth prior art scraper with a second blade in broken line view to show a replacement blade.
Figure 6:
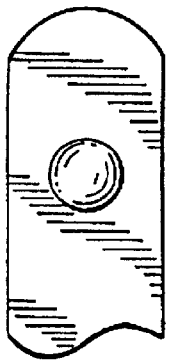
FIG.6 PRIOR ART
FIG. 6 is a distal end view of the scraper of FIG. 7.
Figure 8:
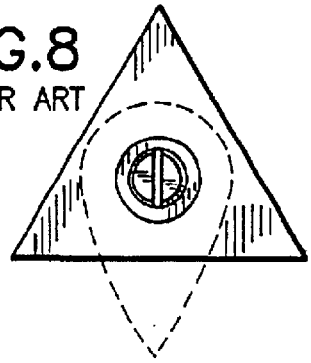
FIG.8 PRIOR ART
FIG. 8 is a distal end view of the scraper of FIG. 7.
Figure 9:
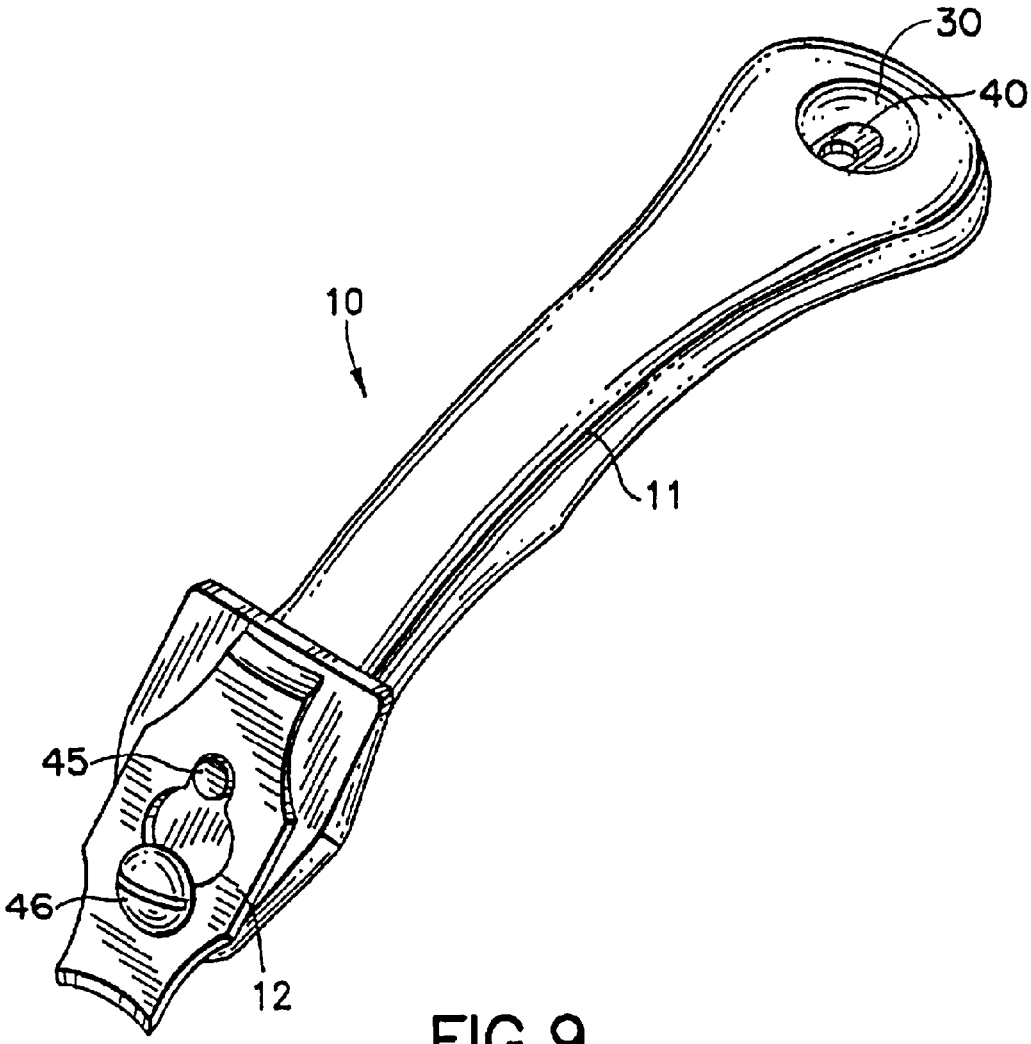
FIG. 9 is a perspective view of the scraper of the present invention.
Figure 12:
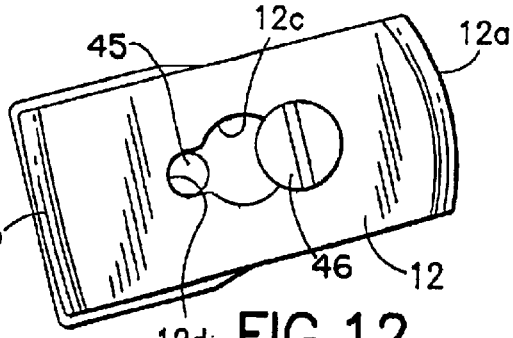
FIG. 12 is an distal end view of the scraper in FIG. 10.

Referring to FIGS. 9–19, there is shown scraper 10 of the present invention. Scraper 10 in general includes an elongated specifically contoured handle 11 and a two-way or double-edged detachable blade 12. Blade 12 is formed with oppositely disposed differently configured blades 12*a* and 12*b* and a central enlarged hole 12*c* with opposed part-circular edges 12*d* (FIG. 12).

Figure 11:
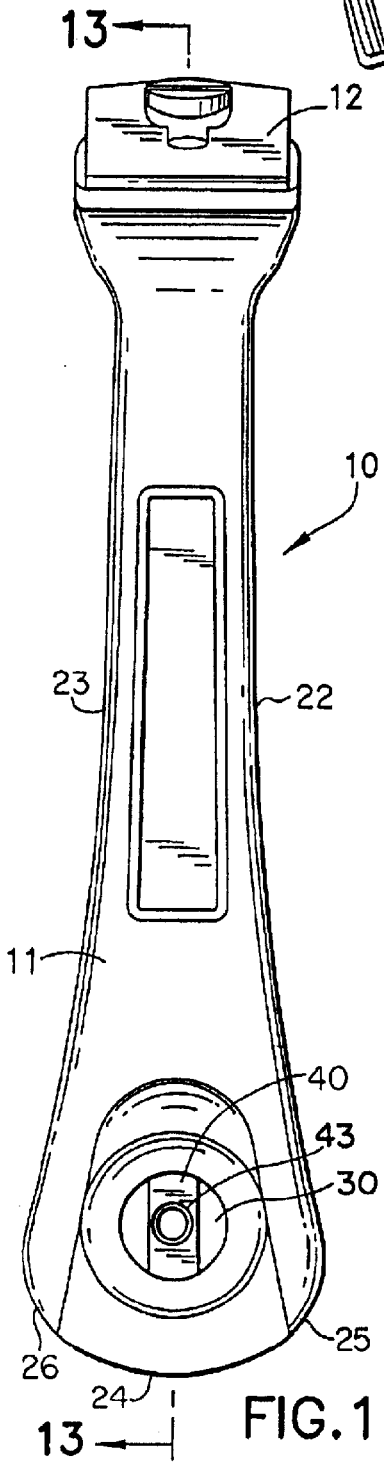
FIG. 11 is a top plan view of the scraper as shown in FIG. 9.
Figure 10:
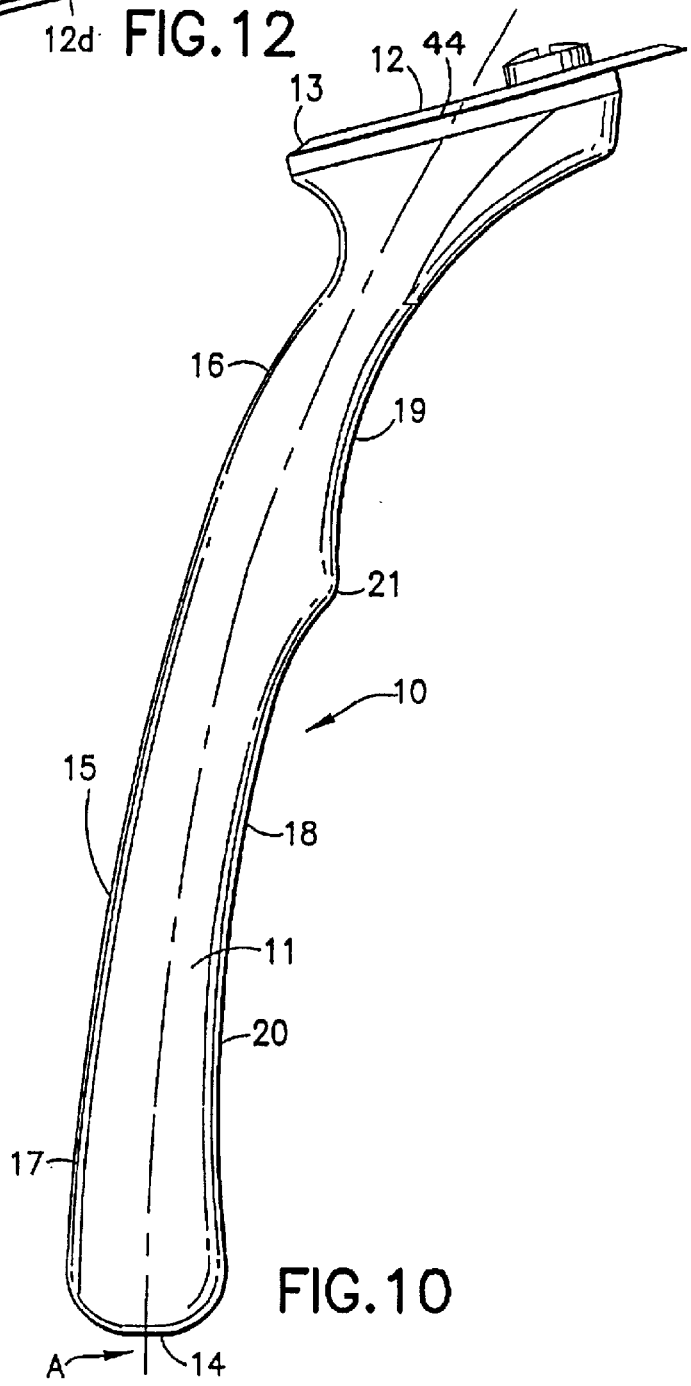
FIG. 10 is a side elevational view of the scraper of FIG. 9.

Handle 11 has an elongated arcuate or curved longitudinal axis A. (FIG. 10) Handle 11 extends from distal end 13 to proximate end 14. Handle 11 has an upper curved surface 15 which has a steep downwardly disposed curved surface 16 towards distal end 13, which is in marked contrast to a very shallow downwardly curved surface 17 at the proximate end 14. Handle 11 has a lower surface 18 which is formed with a distally disposed concave curved surface 19 and a proximately disposed concave curved surface 20. A depending tapered protrusion 21 is disposed between and contiguous with respective surfaces 19 and 20 (FIG. 10). Handle 11 has oppositely disposed elongated sides 22 and 23 which are flared outwardly towards proximate end 14 (FIG. 11).

Figure 13:
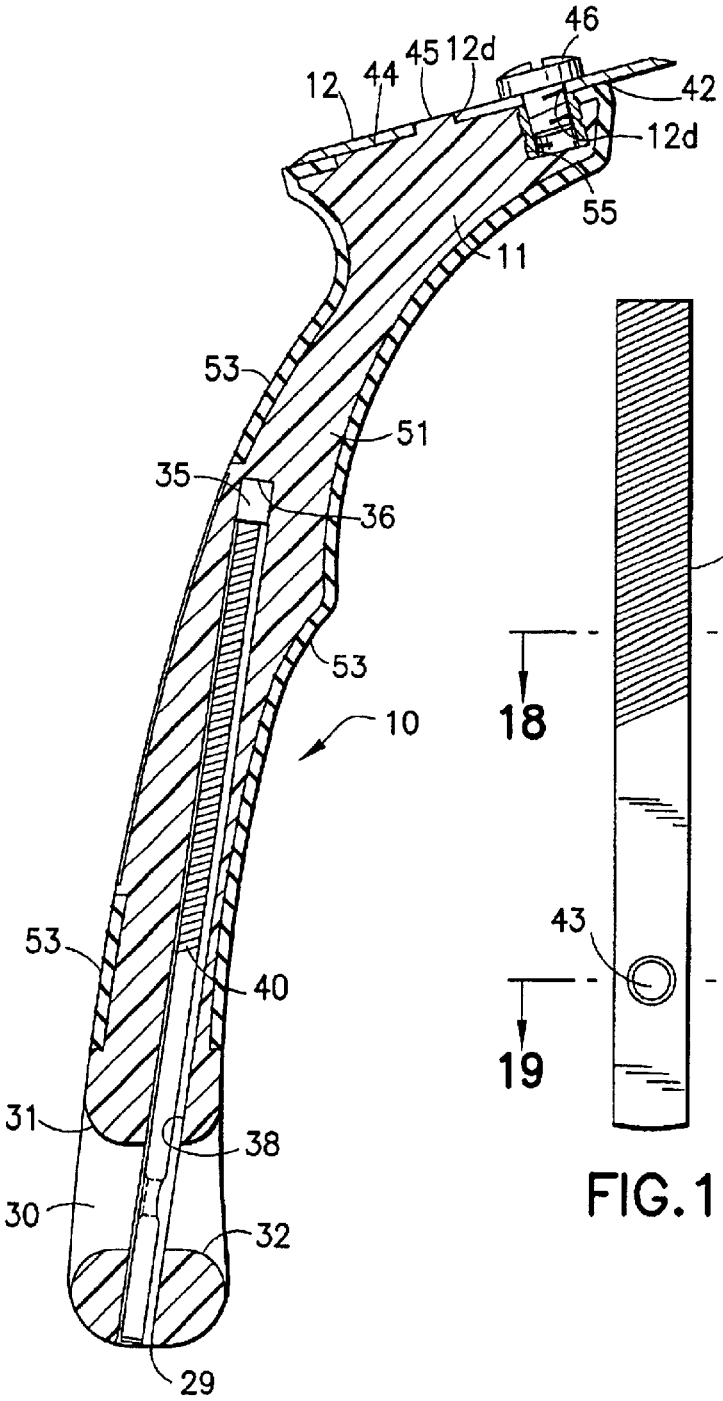
FIG. 13 is a sectional view taken along line 13—13 of FIG. 11.
Figure 14:
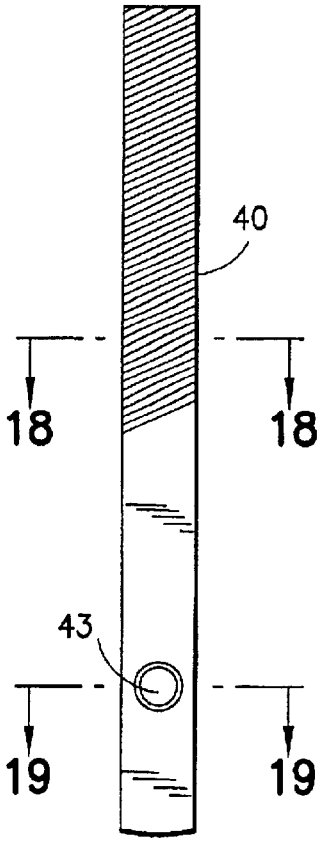
FIG. 14 is a top plan view of the file removed from the scraper of FIG. 10.
Figure 15:
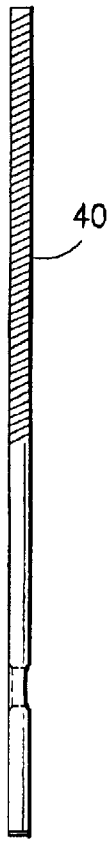
FIG. 15 is a side edge view of the file FIG. 14.
Figure 19:
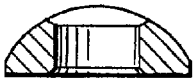
FIG. 19 is an enlarged sectional view taken along line 19—19 of FIG. 14.
Figure 18:
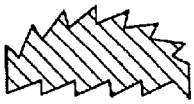
FIG. 18 is an enlarged sectional view taken along line 18—18 of FIG. 14.

Handle proximate end 14 has an arcuate curved end 24 and rounded edges 25 and 26 which are contiguous with respective sides 22 and 23. A hole or slot 29 is formed in end 24 and extends distally to provide recess or cavity 38, for purposes hereinafter appearing (FIG. 13).

A vertically disposed enlarged opening or through hole 30 extends from handle upper surface 15 to handle lower surface 18 adjacent proximate end 14.

Hole 30 is contoured as at 31 adjacent upper surface 15 and at 32 adjacent lower surface 18. Hole 30 is contoured and sized to permit the user's fingers to readily access the hole for the purpose of engaging file 40 to remove the file from the handle.

Recess or cavity 38 extends from end slot 29 to end wall 36. A permanent rare earth metal magnet 35 is fixedly disposed in handle 11 at recess end wall 36. Ferro-metallic file 40 is slidably received through slot 29 and slidably removably disposed in cavity 38. A through hole 43 is formed in file 40. With file 40 fully disposed in recess 38, file 40 contacts magnet 35 and is magnetically held in place. File 40 is accessible through handle hole 30. Scraper 10 can be hook mounted through holes 30 and 43 when not in use. File 40 has a half-round surface for filing concave blade edge (FIG. 9) and a flat file surface for filing straight and convex blade edges, (e.g. FIG. 12).

Handle distal end 13 has a distally downwardly angularly disposed rectangular blade mounting surface 44. Centering pin 45 is integrally formed with and extends upwardly from surface 44. Locking screw 46 is operably disposed in metal insert 55 and disposed adjacent lower edge 42 of surface 44. In this manner of construction, reversible blade 12 is mounted through hole 12*c*. Hole 12*c* is formed with opposed part circular edges or portions 12*d* for respectively alternatively contactingly engaging centering pin 45 and locking screw 46 (FIGS. 12 and 13). Locking screw 46 is locked to hold blade 12 in place, with one blade edge 12*a* operably disposed beyond handle lower edge 42.

In one aspect, the present invention is a two-way reversible blade and handle mounting construction wherein the blade 12 may be removed or reversed without removing the locking screw 46 or any other element. Post 45 and juxtaposed locking screw 46 in combination with the blade opening 12*c* and opposed curved edges or portions 12*d* provide quick blade change and quick blade removal without the need to remove screw 46. In this regard, the center diameter of hole portion 12*c* is larger than screw 46 head. This quick change and quick reversible action without element removal is an improvement over the prior art construction wherein the screw had to be removed or handle disassembled to change blades.

It is within the contemplation of the present invention to provide a plurality of double-edged blades 12, wherein each blade edge e.g. 12*a*, 12*b* is differently contoured to provide differently contoured (e.g. concave, convex and straight) scraping edges for differently contoured work surfaces, particularly including moldings.

Handle 11 has a hard thermoplastic core 51 and a relatively soft integrally molded over elastomeric cover 53. The thermoplastic core and elastomeric cover molding operations are well known in the screwdriver and knife handle art.

Magnet 35 is preferably a rare earth metal magnet and preferably neodymium. The magnet should have a magnetic strength or energy product of at least about $6.0\times10^6$ gauss-oersteds. This high strength magnet holds the magnet in place without the need for a plug or other mechanical retainer. The high magnetic strength pulls the file back into its recessed position even if slightly disposed away from the magnet. Such rare earth metal magnets are commercially available, for example, from Hitachi Magnet Corporation, Division of Hitachi Metals International, Ltd., under the style designations Hicorex 90A, 90B, 96A, 96B, 99A, and 99B.

Figure 16:
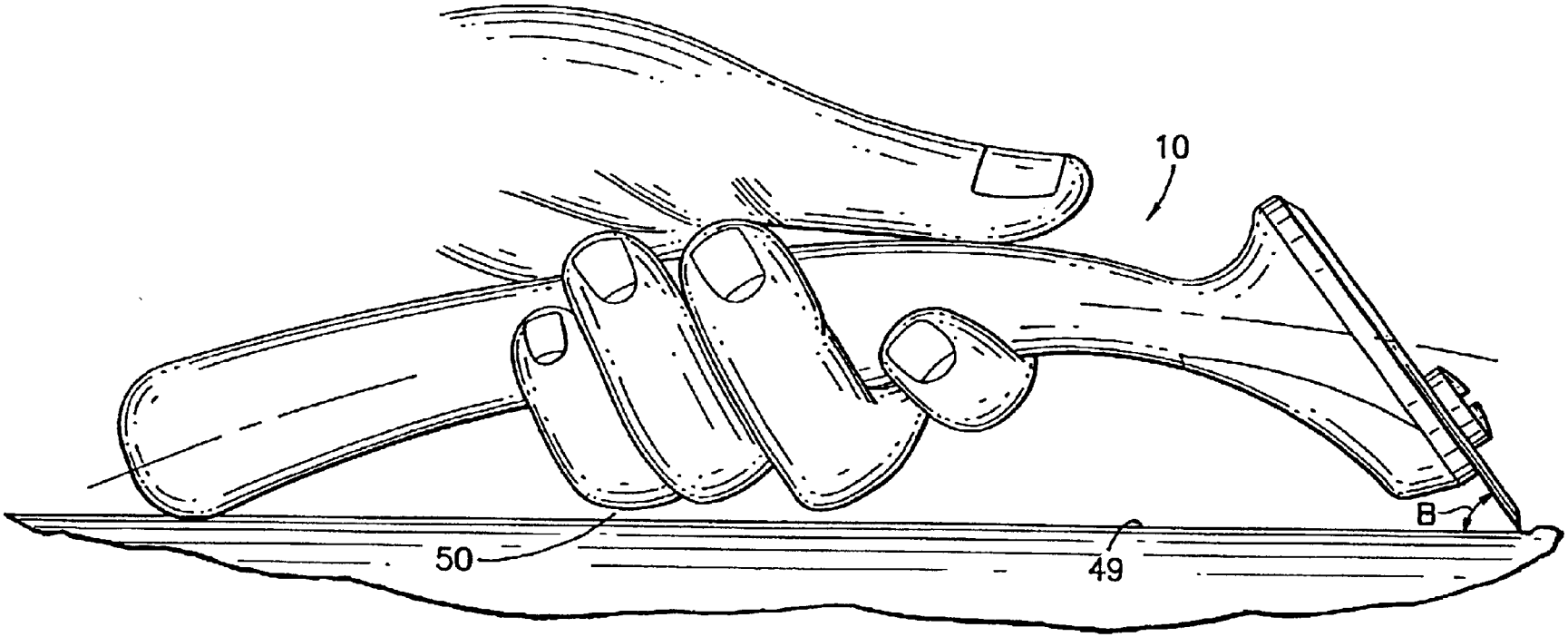
FIG. 16 is a side view of the scraper of FIG. 10 in use in an acute blade angle for scraping operation.
Figure 17:
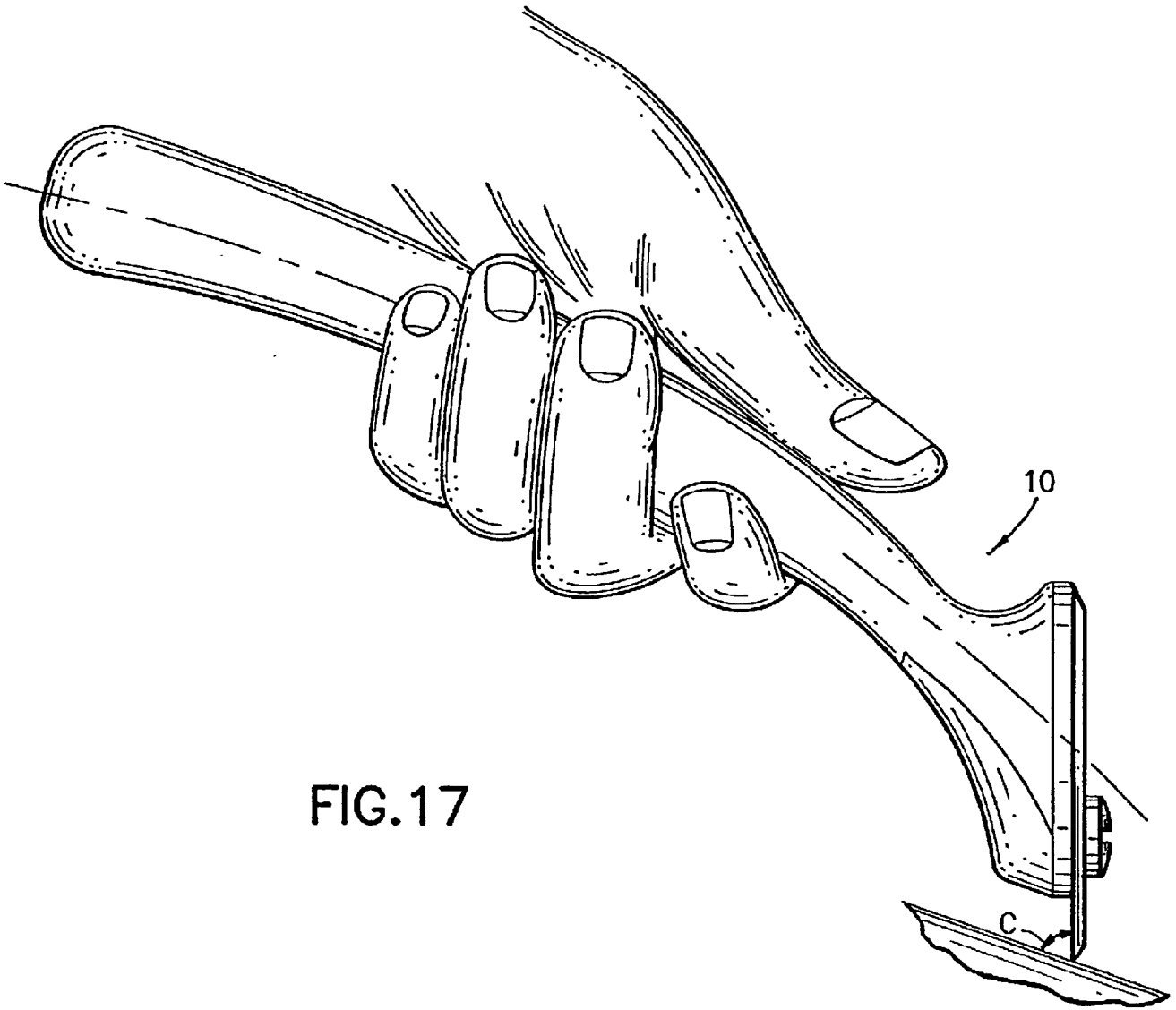
FIG. 17 is a side view to the scraper of FIG. 10 in use in a less acute blade angle scraping operation than in FIG. 16.

Referring to FIGS. 16 and 17 there is, respectively, shown the present contour scraper in a shallow or particularly acute angle scraping operation and in a less acute angle scraping. It is important to note that in the acute angle B scraping operation, the user's knuckles do not contact workpiece surface 49 as there is clearance 50 provided between the user's knuckles and the workpiece surface 49 (FIG. 16). In the less acute C angle scraping operation (FIG. 17), the user's hand is of course disposed further away from the workpiece surface. There is thus shown and described the scraper construction of the present invention which provides a broad range of controlled and improved comfort scraping actions.

While the foregoing describes one embodiment of the invention, it is understood that various modifications may be made within the scope of the invention as defined in the adjoined claims.

What is claimed is:

1. A contour scraper comprising:

a handle, a blade, means for removably attaching said blade to said handle, said handle comprising a distal end and proximate end, an upper surface and a lower surface and oppositely disposed sides, said distal end comprising an angularly disposed surface for operably receiving said blade, and said upper surface is elongated arcuately curved downwardly toward the distal end angularly disposed surface further comprising a file, said handle being formed with a slotted recess for slidably receiving the file for stowage, and further comprising a permanent magnet disposed in said slotted recess to magnetically hold said file in said handle.

2. The contour scraper of claim 1, said handle upper surface being more steeply curved towards the distal end than towards the proximate end.

3. The contour scraper of claim 1, said handle sides being arcuately flared outwardly towards the proximate end.

4. The contour scraper of claim 1, said handle lower surface being formed with two elongated concave surfaces and a downwardly extending protrusion disposed between the lower surface elongated concave surfaces.

5. The contour scraper of claim 4, one said lower concave surface extends from the handle proximate end to the protrusion and the other said lower concave surface extends from the distal end to the protrusion.

6. The contour surface of claim 1, said handle sides being arcuately flared outwardly towards the proximate end, said handle lower surface being formed with two elongated concave surfaces and a downwardly extending protrusion disposed between the lower elongated concave surfaces, and wherein one said lower curved surface extends from the handle proximate end to the downwardly extending protrusion and the other said lower curved surface extends from the distal end to the downwardly extending protrusion.

7. The contour scraper of claim 1, said blade comprising a double-edge, and wherein each edge is differently contoured.

8. The contour scraper claim 7, said means for attaching said blade comprising means for reversibly attaching said blade, wherein one blade edge is operably disposed adjacent a lower edge of the said angularly disposed surface.

9. The contour scraper of claim 1, said magnet comprising a rare earth metal magnet.

10. A contour scraper comprising:

a blade, said handle having a proximate end and a distal end and comprising an elongated grip portion, and a distally transversely disposed portion; said transversely disposed portion being generally planar and having means for detachably attaching said blade; said handle grip portion having an upper surface and a lower surface, said lower surface having elongated concave surfaces further comprising a file, said handle being formed with a slotted recess for slidably receiving the file for stowage, and further comprising a permanent magnet disposed in said slotted recess to magnetically hold said file in said handle.

11. The contour scraper of claim 10, said handle comprising oppositely disposed sides, said sides being flared outwardly toward the handle proximate end.

12. The contour scraper of claim 11, said handle upper surface being more steeply curved adjacent the distal end than adjacent the proximate end.

13. The contour scraper of claim 12, said handle upper surface, sides and lower elongated concave surfaces in combination comprise a contour scraper grip construction.

14. The contour scraper of claim 10, said blade having an enlarged slot, said means for detachably attaching said blade comprising a post and a spatially disposed locking screw disposed in an insert on said transversely disposed surface, said post and screw contactingly engage said blade allowing the blade to be removed or rotated without removing the screw, with the blade slot being wide enough for blade removal and attaching another blade.

15. The contour scraper of claim 14, said blade being formed with a centrally disposed double keyhole being formed with oppositely disposed radially curved portions, and said blade having oppositely disposed blade edges, each said blade hole curved portion being disposed adjacent a respective blade edge.

16. The contour scraper of claim 15, wherein the post contactingly engages one curved portion and the screw contactingly engages the other curved portion, whereby with the screw loosened the blade is reversible so that each blade edge is operably disposed.

17. The contour scraper of claim 10, said handle comprising an inner thermoplastic core and outer softer elastomeric cover.

18. A contour scraper comprising:

a handle, a two-edged blade, said blade being formed with an opening having two opposed portions, said handle having a distally disposed, angularly disposed surface for receiving the blade, a post and locking means being spatially disposed on said surface, wherein the post engages the other blade opening portion, whereby the locking means locks the blade to the surface so this one blade edge is operably disposed further comprising a file, said handle being formed with a slotted recess for slidably receiving the file for stowage and, further comprising a permanent magnet disposed in said slotted recess to magnetically hold said file in said handle.

19. The contour scraper of claim 18, said locking means comprising a locking screw having a head and screw shank and a screw receiving insert disposed in the handle, and said blade opening having a third portion of greater size than the screw head, wherein loosening the screw the blade is reversed or removed without necessarily removing the screw.

20. The contour scraper of claim 18, said post being of integral one-piece construction with said handle.

21. The contour scraper of claim 18, each blade opening portion comprising a part circular edge and said post comprising a cylindrical portion and said locking means comprising a cylindrical portion, wherein said cylindrical portions contactingly engage respective part circular edges.

22. The contour scrape of claim 18, said handle being formed with a hole, said hole being transversely disposed to said file, whereby the user accesses the tile through the hole to remove the file.

* * * * *